US009966689B2

(12) United States Patent
Meier et al.

(10) Patent No.: US 9,966,689 B2
(45) Date of Patent: May 8, 2018

(54) CONTACT CARRIER

(71) Applicant: HARTING ELECTRIC GMBH & CO. KG, Espelkamp (DE)

(72) Inventors: Heiko Meier, Minden (DE); Stefan Schnieder, Bohmte (DE)

(73) Assignee: HARTING ELECTRIC GMBH & CO. KG (DE)

( * ) Notice: Subject to any disclaimer, the term of this patent is extended or adjusted under 35 U.S.C. 154(b) by 0 days. days.

(21) Appl. No.: 15/101,847

(22) PCT Filed: Feb. 19, 2015

(86) PCT No.: PCT/DE2015/100067
§ 371 (c)(1),
(2) Date: Jun. 3, 2016

(87) PCT Pub. No.: WO2015/124146
PCT Pub. Date: Aug. 27, 2015

(65) Prior Publication Data

US 2016/0359259 A1 Dec. 8, 2016

(30) Foreign Application Priority Data

Feb. 20, 2014 (DE) ..... 10 2014 102 171

(51) Int. Cl.
*H01R 13/60* (2006.01)
*H01R 13/514* (2006.01)
(Continued)

(52) U.S. Cl.
CPC ..... *H01R 13/514* (2013.01); *H01R 13/502* (2013.01); *H01R 13/518* (2013.01); *H01R 13/6315* (2013.01)

(58) Field of Classification Search
CPC H01R 13/639; H01R 13/518; H01R 23/7073; H01R 13/501; H01R 13/514; H01R 9/26; H01R 13/506
(Continued)

(56) References Cited

U.S. PATENT DOCUMENTS 4,332,432 A * 6/1982 Colleran ..... H01R 13/62905 439/157
4,655,515 A * 4/1987 Hamsher, Jr. ..... H01R 23/662 29/858
(Continued)

FOREIGN PATENT DOCUMENTS

CN 102738675 10/2012 ..... H01R 4/48
DE 19707120 6/1998 ..... H01R 13/514
(Continued)

OTHER PUBLICATIONS

International Search Report and Written Opinion (no translation) issued in application No. PCT/DE2015/100067, dated Jun. 18, 2015 (10 pgs).
(Continued)

*Primary Examiner* — Thanh Tam Le
(74) *Attorney, Agent, or Firm* — Hayes Soloway P.C.

(57) ABSTRACT

The invention relates to a contact carrier (1) for holding contact elements and for bringing into contact with a corresponding contact carrier. The contact carrier (1), which is made of an insulating material, has a plurality of cavities (4) in order to hold the contact elements, which cavities extend in a plugging direction through the entire contact carrier (1) and a retaining region (3) of the contact carrier and a plugging region (2) of the contact carrier. According to the invention, the contact carrier (1) has an insertion bevel (8), which insertion bevel makes it easier to bring the contact carrier (1) into contact with a corresponding contact carrier. The invention relates to improvements in the plugging
(Continued)

region in order to avoid incorrect plugging of two contact carriers, in particular a resting of the contact carriers during the plugging process.

8 Claims, 4 Drawing Sheets

(51) Int. Cl.
*H01R 13/502* (2006.01)
*H01R 13/518* (2006.01)
*H01R 13/631* (2006.01)

(58) Field of Classification Search
USPC ..... 439/347, 540.1, 541.5, 596, 701, 716, 439/902
See application file for complete search history.

(56) References Cited

U.S. PATENT DOCUMENTS 5,171,156 A * 12/1992 Nagasaka ..... H01R 13/62938 439/157
5,252,089 A * 10/1993 Hatagishi ..... B60R 16/02 439/310
5,263,871 A * 11/1993 Sano ..... H01R 13/62933 439/157
5,433,619 A * 7/1995 Maejima ..... H01R 13/62933 439/157
5,454,733 A 10/1995 Watanabe et al. ..... 439/540.1
5,607,327 A * 3/1997 Tsuji ..... H01R 13/4365 439/595
5,660,555 A 8/1997 Ito et al. ..... 439/278
5,725,397 A 3/1998 Fukamachi et al. ..... 439/701
6,004,162 A * 12/1999 Harting ..... H01R 13/518 439/532
6,126,470 A * 10/2000 Ono ..... H01R 13/62972 439/310
6,767,241 B1 * 7/2004 Abel ..... H01R 24/64 439/417
6,881,100 B2 * 4/2005 Barry ..... H01R 12/716 439/701
7,201,607 B2 * 4/2007 Bernhart ..... H01R 13/748 439/532
7,347,744 B2 * 3/2008 Tabata ..... H01R 13/514 439/289
7,367,850 B1 * 5/2008 Chang ..... H01R 13/518 439/540.1
7,878,860 B1 * 2/2011 Ouellette ..... H01R 13/502 439/638
8,142,218 B2 3/2012 Rudolph et al. ..... 439/357
8,827,741 B2 * 9/2014 Johnson ..... H01R 13/518 439/541.5
9,039,458 B2 * 5/2015 Tsuchiya ..... H01R 13/4365 439/686
2011/0269327 A1 11/2011 Ouellette et al. ..... 439/345

FOREIGN PATENT DOCUMENTS

DE 60206228 6/2006 ..... H01R 12/50
DE 202013103611 9/2013 ..... H01R 13/514
EP 1283559 9/2005 ..... H01R 12/16
JP 2004006169 1/2004 ..... G01R 1/073
RU 2064213 7/1996 ..... H01R 13/52
RU 2423762 7/2011 ..... H01R 11/00

OTHER PUBLICATIONS

German Office Action (no translation) issued in application No. 10 2014 102 171.1, dated Oct. 20, 2014 (7 pgs).
International Preliminary Report on Patentability issued in application No. PCT/DE2015/100067, dated Sep. 1, 2016 (10 pgs).
Russian Office Action (w/machine translation) issued in application No. 2016125129/07, dated Oct. 30, 2017 (4 pgs).
Chinese Office Action (w/ translation) issued in application No. 201580008778.x, dated Dec. 14, 2017 (15 pgs).

* cited by examiner

CONTACT CARRIER

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The invention relates to a contact carriers.

Contact carriers are required in connection technology in order to receive contacts, preferably in plug connectors. Here, the contact carrier serves to receive contact elements such as electric, pneumatic or optical contacts.

The contact carrier has cavities, in which the contact elements are received and secured. The cavities are usually formed here as bores, which penetrate the contact carrier completely. On a side of the contact carrier referred to as the connection side, a conductor can thus be conductively connected to the contact element received in the cavity.

On the side opposite the connection side, referred to as the plugging side, the contact element received in the cavity is provided with a second contact carrier for contacting. The second contact carrier is preferably likewise received here in a plug connector, which can be connected to the plug connector of the first contact carrier.

Depending on the embodiment of the plug connector and of the contact carrier, it is also conceivable to arrange different types of contact elements in a contact carrier. By way of example, power and signal lines can be contacted and transferred simultaneously.

In a particular embodiment of contact carriers these are formed as modules. A plurality of these modules can be inserted, assembled together, into a plug connector. This embodiment eradicates the need to produce a special contact carrier for a plug connector for each particular application, and instead makes it possible to combine different modules having different contact elements with one another.

The present invention relates to a further embodiment of modular plug connectors of this type. In this particular type of modular plug connector, individual contact carriers (modules) are inserted into a frame and held together thereby. What is known as the module frame is received with inserted modules in a plug connector housing and thus forms the modular plug connector.

DESCRIPTION OF THE PRIOR ART

A mounting frame for securing plug connector modules and for installation in a plug connector housing or for screwing to wall surfaces is known from DE 197 07 120 C1. Here, securing means are provided on the plug connector modules, which securing means cooperate with recesses provided in oppositely arranged wall parts of the mounting frame. The plug connector modules received in the mounting frame are intended for contact with corresponding plug connector modules in a mating plug connector.

Here, the contact carriers (plug connector modules) are substantially square in shape. This enables a close successive arrangement of a plurality of modules. Contact carriers of this type are also known from the non-modular field of plug connectors. Here, an accordingly larger contact carrier is inserted into a plug connector housing and serves as an insulation body for receiving and contacting contact elements.

A disadvantage in the case of these modular and non-modular insulation bodies for plug connectors known from the prior art is that, when the plug connector is contacted with a mating plug connector, a minimum level of accuracy is necessary. Fault-free contacting is only possible when enough importance is placed on the alignment of the plug connector and mating plug connector.

However, this is not always ensured when the contacting of plug connectors is not performed manually, i.e. by hand by a user, but is performed automatically. Plug connections are very often produced by robots, together with machine parts or other machine parts. If, by way of example, entire machine modules are swapped in large industrial installations, the plug connectors, when joining together the machine component parts, must be aligned with one another with very small tolerances.

If this is not the case, this may lead in the worst-case scenario to the destruction of the plug connector when the insulation bodies do not slide correctly inside one another and instead rest on top of one another. An error of this type in a large installation can only be rectified with difficulty.

This problem becomes all the more relevant when the plug connector systems are modular in nature. Since each individual plug connector module has a certain tolerance and play, these tolerances add up. In the worst-case scenario, a contacting of a plurality of modular plug connectors is not even possible without human intervention.

Faulty plugging of this type occurs particularly when the tolerances of rectangular or square contact carriers in two spatial dimensions are used to the maximum. In a system of two contactable contact carriers, which may each have a tolerance of 0.5 mm in two directions, an effective offset in the diagonal direction between the two directions of 0.71 mm results with maximum utilization of this tolerance in both directions ($\text{offset}=\sqrt{0.5^2\times0.5^2}$). Faulty plugging of the contact carrier is the result.

SUMMARY OF THE INVENTION

The problem addressed by the invention lies in presenting a contact carrier for plug connectors which eliminates or at least minimizes the disadvantages of the contact carriers and plug connectors known from the prior art. Here, the contact carrier and the contact carrier of a second plug connector can be easily guided together one inside the other. The risk of the contact carriers resting one on top of the other will be minimized, even in the event of inaccurate contacting.

The contact carrier is a substantially rectangular or square main body. The main body is divided into a retaining region and a plugging region. One or more cavities is/are provided in the contact carrier, such that it/they fully penetrates/penetrate the contact carrier and is/are arranged (in regions) in the retaining region and the plugging region.

The cavities are intended to receive contact elements, wherein the contact elements are secured and held in the retaining region of the contact carrier. The contact elements can be optionally electric, pneumatic or optical contact elements. The contact elements are preferably formed such that they can be connected by means of the part arranged in the retaining region to a conductor to be connected. The connected conductor can leave the cavity in the retaining region of the contact carrier.

With use of electric contact elements it is expedient to produce the contact carrier from an insulating material in order to ensure electrical insulation of the contact elements with respect to one another.

The retaining region of the contact carrier expediently has, on its outer side, means which are suitable for securing the contact carrier in a plug connector. The means can be formed as a securing flange in order to secure the contact carrier in a plug connector housing using screws or similar aids.

In accordance with a further embodiment, moldings are provided on the contact carrier in the region of the modular plug connector, by means of which moldings the contact carrier can be received in a form-fitting manner in a mounting frame, for example.

The plugging side of the contact carrier has at least four side faces, which extend away from the retaining region and are terminated by a cover face terminating the plugging side. Openings of the cavities are provided in the cover face and extend through the contact carrier. The access and contacting of the contact elements in the cavities are ensured by the openings.

Between the side faces and the cover face, the contact carrier forms a peripheral edge. In accordance with the invention the edge is provided with a chamfer serving as an insertion bevel. The insertion bevel solves the problem addressed by the invention of increasing the plugging reliability and preventing faulty plugging caused by contact carriers resting one on top of the other.

In an expedient embodiment the insertion bevel on the contact carrier measures between 0.2 mm and 2.5 mm transversely to the plugging direction. In an embodiment consistent with standard EN 175301-801:2006, the insertion bevel is at least 0.5 mm wide transversely to the plugging direction. In a preferred embodiment the insertion bevel is between 0.3 mm and 0.8 mm wide transversely to the plugging direction.

The design of the insertion bevel at a 45° angle has proven to be particularly expedient. However, insertion bevels having angles between 20° and 70° are also conceivable. Insertion bevels in the range between 35° and 55° are advantageous.

The contact carrier is formed in a further embodiment such that no edge, but instead a radius, is formed in each case between two side faces abutting one another.

In this embodiment of the contact carrier the problem of faulty plugging when joining to a further contact carrier is particularly great.

Due to the rounded edges between the side faces, the chamfer on the cover face forming the insertion bevel likewise forms a radius. With a uniformly peripheral chamfer of 0.5 mm for example, the maximum offset of the contact carrier relative to a corresponding contact carrier by 0.5 mm in each of the x- and y-directions results in an effective offset in the diagonal direction (in the direction of the rounded edge between the side faces) of 0.71 mm (offset=$\sqrt{0.5^2 \times 0.5^2}$).

Since, however, the peripheral insertion bevel allows only a 0.5 mm offset at any point, the contact carrier cannot be plugged to the corresponding contact carrier. In order to eliminate this error, the contact carrier in accordance with the invention has a stepped recess in the cover face in the region of the rounded edges between the side faces. The contact carrier is therefore prevented from resting on a corresponding contact carrier.

The stepped recess is expediently formed with the same dimensions as the insertion bevel on the contact carrier. It is thus ensured that a resting in the rounded corner region is prevented, even with maximum offset of two contact carriers relative to one another.

An offset of plug connectors of this type is also stipulated in the standardization. Plug connectors according to EN 175301-801:2006 must therefore be able to compensate for an offset of 0.5 mm in the longitudinal and transverse direction. As already described, this is not possible with an insertion bevel of 0.5 mm. So as not to have to make the insertion bevels unnecessarily large, a plug connector according to the teaching of the present invention meets the requirements of EN 175301-801:2006.

BRIEF DESCRIPTION OF THE DRAWINGS

An exemplary embodiment of the invention is illustrated in the drawings and will be explained in greater detail hereinafter. In the drawings.

DETAILED DESCRIPTION OF THE INVENTION

The figures contain schematic illustrations simplified in part. Identical reference signs are sometimes used for elements that are similar, but possibly not identical. Different views of the same elements could be scaled differently.

Figure 1:
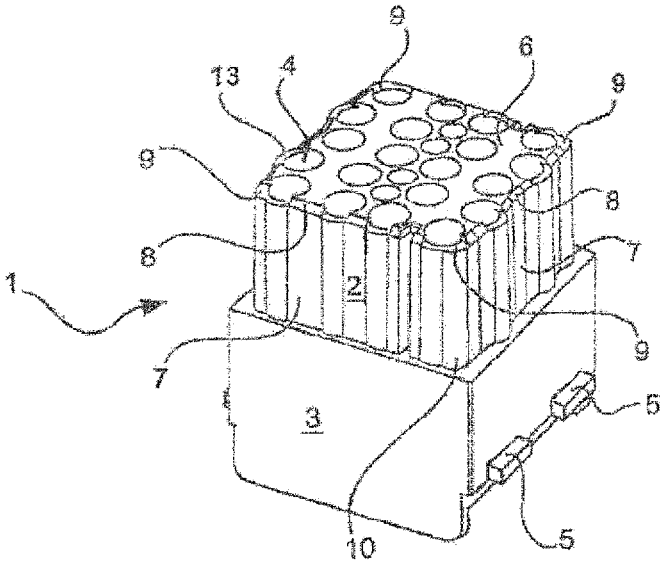
FIG. 1 shows a perspective illustration of a contact carrier.

FIG. 1 shows a contact carrier 1 from a perspective view. The contact carrier 1 has two regions, wherein the region illustrated here at the bottom forms a retaining region 3 and the region illustrated here at the top forms a plugging region 2.

A multiplicity of cavities 4 are formed in the contact carrier 1. Here, the cavities 4 extend from a cover face 6 terminating the plugging region 2 through the entire plugging region 2 and the entire retaining region 3. The cavities 4 exit from the retaining region 3 of the contact carrier 1—and also from the plugging region 2—on the terminating face of the retaining region 3 (said face not being visible here).

The cavities 4 are intended to receive contact elements. Here, contact elements are held in the retaining region 3 in the cavities 4 and extend via a plugging end into the plugging region 2. The contact elements can be connected by the openings of the cavities 4 in the holding regions 3 to a cable to be connected.

Besides the accommodation and securing of contact elements, the retaining region 3 is also intended to secure the contact carrier 1 itself. A securing arrangement or means 5 are provided for this purpose on the contact carrier 1 in the retaining region 3, which means are intended to receive and secure the contact carrier 1 in a plug connector.

Here, the means 5 can assume different embodiments known from the prior art. In the shown exemplary embodiment cuboidal moldings are provided as means 5 on the contact carrier 1. The cuboidal means 5 can be inserted into corresponding recesses in a modular frame. The contact carrier 1 is thus held in the modular frame.

By inserting a plurality of contact carriers 1 in a modular frame of this type, a modular plug connector is thus assembled. The finished, loaded modular frame can be secured in a plug connector housing. The securing of a contact carrier 1 directly in a plug connector housing is also conceivable.

Figure 7:
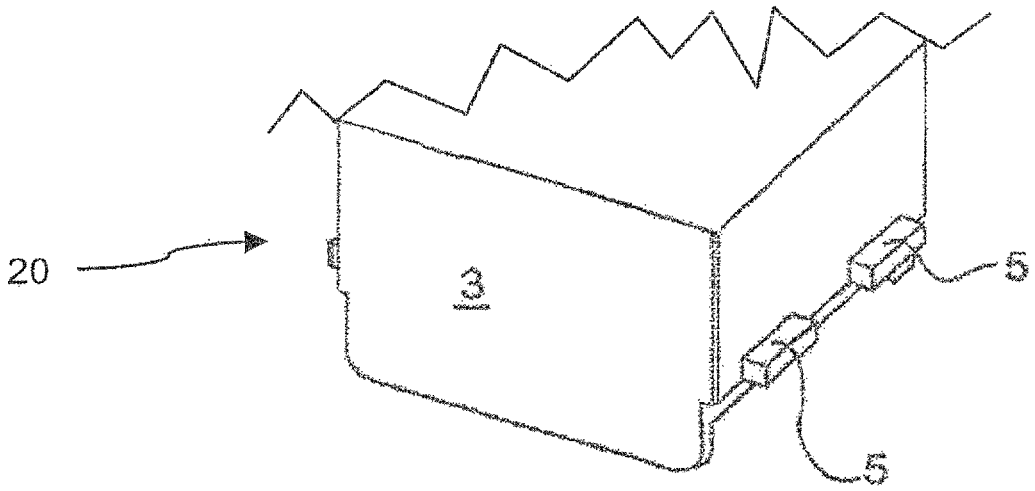
FIG. 7 shows details of the securing arrangement on the retaining region of the FIG. 1 contact carrier.

The plugging region 2 of the contact carrier 1 is provided for joining to the plugging region of a corresponding contact carrier 20. By plugging the plugging region 2 into the plugging region of the contact carrier 20, the contact elements received in the contact carriers 1, 20 are connected to one another and contacted with one another. FIG. 7 shows the contact carrier 20 has a securing arrangement or means 5 on the retaining region 3 for securing the contact carrier 20.

The plugging region of the contact carrier 20 is expediently formed such that it surrounds the plugging region 2 of the contact carrier 1 in the plugged-in state. Contact elements protruding into the plugging region of the contact carrier 20 can thus protrude into the cavities 4 of the contact carrier 1 and contact the contact elements received therein.

The plugging region 2 of the contact carrier 1 in the illustrated embodiment has four side faces 7, and a terminating cover face 6. Here, the side faces 7 are each interconnected by a radius 10.

A peripheral chamfer is provided on the contact carrier 1 in the transition between the side faces 7 and the cover face 6. The peripheral chamfer serves as an insertion bevel 8. The insertion of the plugging region 2 of the contact carrier 1 into a plugging region of a corresponding contact carrier 20 is thus simplified. Depending on the size of the insertion bevel 8, the contact carriers 1, 20 can be joined one inside the other with a greater tolerance.

In accordance with the invention recesses 9 are formed in the contact carrier 1 in the corner regions of the plugging region 2. The recesses 9 are dimensioned such that they omit the corner region of the insertion bevel 8 rounded by the radius 10. The problem according to the invention, i.e. that with utilization of the insertion bevels 8 in two directions (x, y) a joining together of contact carriers 1, 20 is prevented, is thus eliminated. The problem according to the invention will be illustrated again in greater detail in FIG. 2.

Figure 2:
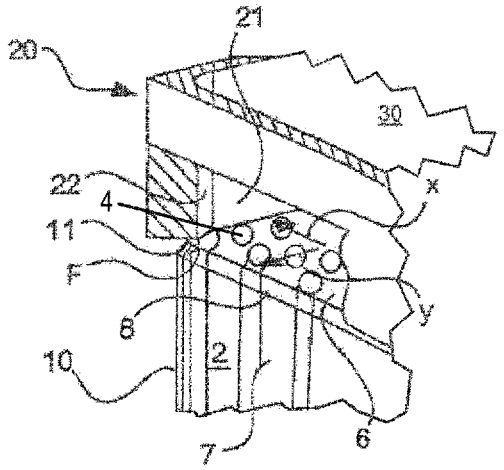
FIG. 2 shows a contact carrier with a corresponding contact carrier in partial section.

FIG. 2 shows a detail of a contact carrier 1 and of a corresponding contact carrier 20 arranged thereabove. Here, the contact carrier 20 which is formed such that the plugging region of the contact carrier includes a further cavity 30 which is accessible from the cover face, is illustrated in a partial section in order to provide a view of the interior of the contacting of the contact carriers 1, 20.

Only part of the plugging region of the contact carrier 20 is illustrated. The rest of the contact carrier 20 above the plugging region has not been illustrated for reasons of clarity. A side face 21 of the contact carrier 20 has been cut open in the front region. A view of the insertion bevel 8 of the contact carrier 1 illustrated at the bottom is thus possible. The contact carrier 1 is also illustrated only in part.

Details such as the cavities 4 have been omitted from this view. Merely the elements relevant for the explanation are illustrated.

To the left, the radius 10 between the side faces 7 of the contact carrier 1 can be seen, said radius forming a chamfer, likewise by means of the insertion bevel 8, at the upper end facing towards the contact carrier 20. Due to the insertion bevel 8, the radius 10 at the edge 11 towards the cover face 6 is smaller.

The plugging regions of the contact carriers 1, 20 are expediently dimensioned such that the plugging region 2 of the contact carrier 1 can be introduced in a form-fitting manner into the plugging region of the contact carrier 20. For this purpose it is advantageous to select the radius 22 between the side faces 21 of the contact carrier 20 to be slightly larger than the radius 10 between the side faces 7 of the contact carrier 1.

FIG. 2 illustrates a state in which, as the contact carriers 1, 20 are joined, the insertion bevel 8 is fully utilized both in the X-direction and in the Y-direction. Due to the offset of the contact carrier 1 relative to the contact carrier 20 by the width of the insertion bevel 8 in the X- and Y-direction, a diagonal offset of $\sqrt{2*(\text{widthoftheinsertionbevel})^2}$ directed to the radius 22 results. This offset, however, is greater than the width of the insertion bevel 8 in the region F of the radius 22. The contact carrier 20 therefore rests on the contact carrier 1 in the region F with maximum X- and Y-offset.

In the case of a mechanical, not manual contacting of the contact carriers 1, 20, unavoidable damage would thus occur at the contact carriers 1, 20.

Figure 3:
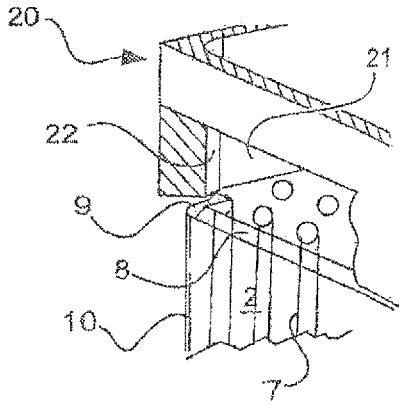
FIG. 3 shows a further contact carrier with a corresponding contact carrier in partial section.

FIG. 3 shows a detail of a contact carrier 1 and also of a corresponding contact carrier 20 arranged thereabove, from exactly the same view as FIG. 2. In FIG. 3, however, the contact carrier 1 is illustrated in a further embodiment, in which a recess 9 is formed in the insertion bevel 8 in the corner region of the contact carrier 1.

The problem according to the invention, which is explained in greater detail in FIG. 2, is solved by the recess 9 in the corner region of the contact carrier 1. An overlap of the radius 22 of the contact carrier 20 with the smaller radius 11 at the insertion bevel 8 of the contact carrier 1 is avoided. Even when the insertion bevel 8 is fully utilized in the X-direction and in the Y-direction, it is no longer possible for the contact carrier 20 to rest on the contact carrier 1.

Particularly in the automated field, when plug connections are plugged mechanically by robots or when large machine modules are swapped, there is thus no longer any need for manual intervention to ensure complete contacting. The risk of faulty plugging in the area of defective contact F (FIG. 2) is considerably minimized.

Figure 4:
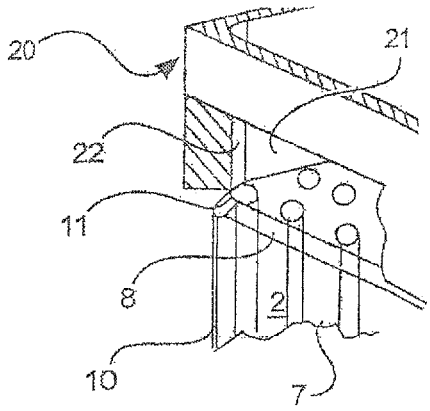
FIG. 4 shows a further contact carrier with a corresponding contact carrier in partial section.

A further embodiment of the invention is illustrated in FIG. 4. This again shows a detail of a contact carrier 1 and of a corresponding contact carrier 20 arranged thereabove as in FIG. 2, from the exact same view. In FIG. 4, however, the contact carrier 1 is not provided with a recess 9 in the corner region of the contact carrier 1.

The function of the recess 9 is provided in this embodiment by an enlargement of the radius 11. Due to a larger radius between the insertion bevel 8 and the cover face 6 in the region of the radii 10, the edge with the radius 11 fits the radius 22 of the contact carrier 20.

Due to the radius enlargement, the same effect is attained as that attained by the introduction of a recess 9. The contact carrier 20 no longer rests on the contact carrier 1, not even in the event of complete utilization of the insertion bevel 8 in the X-direction and in the Y-direction. In other words, one of the contact carriers has a peripheral edge on the region between the side faces 7 and the cover face 6 of the plugging region of the contact carrier 1, wherein the enture edge is formed as an insertion bevel 8.

Figure 5:
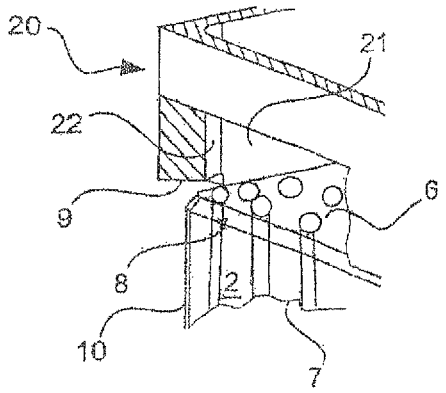
FIGS. 5 and 6 show two further embodiments of the invention.
Figure 6:
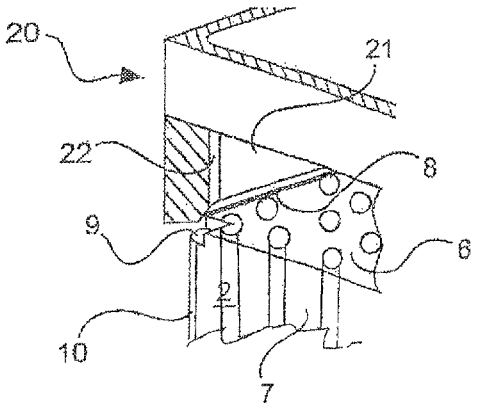

FIGS. 5 and 6 show two further special embodiments of the invention. The embodiments are illustrated in the same view as the embodiments in FIGS. 2, 3 and 4.

In the embodiment of FIG. 5 the insertion bevel 8, as is already known from FIGS. 1 to 4, is integrally molded on the contact carrier 1. By contrast, the recess 9 is provided on the corresponding contact carrier 20.

Here, the recess 9 is arranged facing toward the contact carrier 1 in the corner region between the side faces 21. The same effect according to the invention as in the first shown embodiment (FIG. 1 and FIG. 3) is thus achieved.

The embodiment shown in FIG. 6 also achieves the same effect. Here, the insertion bevel 8 is integrally molded on the corresponding contact carrier 20. The recess 9 is integrally molded on the contact carrier 1 as in the exemplary embodiment of FIG. 3.

The invention claimed is:

1. A contact carrier formed from an insulating material, and having a substantially rectangular shape, forming at least one cavity for receiving a contact element, wherein the contact carrier has a plugging region and a retaining region, wherein the at least one cavity extends at least through the retaining region, along a plugging direction of the contact carrier, wherein the contact carrier has a securing arrangement on the retaining region for securing the contact carrier, and wherein the plugging region of the contact carrier comprises at least four side faces abutting one another and extending away from the retaining region, and also comprises an integral cover face, which terminates the plugging region and which forms the plugging face of the contact carrier, wherein a peripheral edge is formed in a region between the side faces and the cover face of the plugging region, wherein the edge is formed as an insertion bevel, wherein the plugging region is provided with a radius at corner regions of the contact carrier between two side faces abut one another, wherein the insertion bevel is interrupted by recesses in a region of the radius, and the insertion bevel also is interrupted by other recesses in regions other than the corner regions of the contact carrier, and in which the at least one recess approaches one of the side faces.

2. The contact carrier as claimed in claim 1, wherein the insertion bevel has an angle between 20° and 70° to the cover face.

3. The contact carrier as claimed in claim 1, wherein the insertion bevel measures from at least 0.2 mm to at most 2.5 mm transversely to the plugging direction.

4. The contact carrier as claimed in any claim 1, wherein the recesses of the insertion bevel are dimensioned in the region of the radius such that the level of the cover face is reduced by at least the height of the insertion bevel against the plugging direction of the contact carrier.

5. The contact carrier as claimed in claim 1, wherein the other recesses of the insertion bevel are dimensioned in the region of the radius such that the other recesses extend from the side faces by at least the width of the insertion bevel into the plugging region, transversely to the plugging direction.

6. The contact carrier as claimed in claim 1, wherein the at least one cavity extends through the retaining region and the plugging region extends along the plugging direction through the contact carrier.

7. The contact carrier as claimed in claim 1, wherein the plugging region of the contact carrier comprises a further cavity, which is accessible from the cover face, and inner sides of the cavity form the side faces.

8. The contact carrier as claimed in claim 1, wherein said recesses are formed by an enlargement of an inner radius formed in the region of the radii between the insertion bevel and the cover face.

* * * * *